United States Patent [19]

Hatano et al.

[11] Patent Number: 5,023,669

[45] Date of Patent: Jun. 11, 1991

[54] IMAGE FORMING APPARATUS HAVING AN INTERMEDIATE SHEET ALIGNMENT AND RECEIVING UNIT

[75] Inventors: Masaru Hatano, Amagasaki; Yoshiaki Tabata, Sakai, both of Japan

[73] Assignee: Mita Industrial Co., Ltd., Osaka, Japan

[21] Appl. No.: 430,342

[22] Filed: Nov. 2, 1989

[30] Foreign Application Priority Data

Nov. 11, 1988 [JP] Japan ..... 63-147919

[51] Int. Cl.[5] ..... G03G 21/00

[52] U.S. Cl. ..... 355/319; 271/3.1; 271/223; 355/308

[58] Field of Search ..... 355/308, 316, 318, 319; 271/3.1, 207, 223, 225, 226, 234

[56] References Cited

U.S. PATENT DOCUMENTS 3,658,323 5/1972 Matwey ..... 271/223 X
4,705,389 11/1987 Maekawa et al. ..... 355/319 X

FOREIGN PATENT DOCUMENTS 0072525 5/1982 Japan ..... 271/3.1
0228465 4/1985 Japan ..... 355/316
0141460 6/1986 Japan ..... 355/219
0228463 10/1986 Japan ..... 355/219
0230165 10/1986 Japan ..... 355/219

*Primary Examiner*—A. T. Grimley
*Assistant Examiner*—J. E. Barrow, Jr.
*Attorney, Agent, or Firm*—Beveridge, DeGrandi & Weilacher

[57] ABSTRACT

An image forming apparatus having a receiving unit for receiving a sheet on which a first image is formed. The receiving unit includes an inlet for receiving the sheet, a tray member for supporting the received sheet, an outlet through which the received sheet is re-fed, and an aligning device. The aligning device includes a pair of standing members positioned on the tray member in spaced relationship with each other a predetermined distance. The standing members extend upward to a level which is higher than the inlet. And at least one of the pair of standing members has a widened portion for guiding the sheet passing through the sheet inlet. The sheet is guided by the widened portion and aligned on the tray member by the pair of standing members and the sheet is re-fed out of the tray member to form a second image.

10 Claims, 3 Drawing Sheets

IMAGE FORMING APPARATUS HAVING AN INTERMEDIATE SHEET ALIGNMENT AND RECEIVING UNIT

BACKGROUND OF THE INVENTION

1. Field of the Invention

This invention relates to an image forming apparatus, and, more specifically, to an image forming apparatus which is capable of duplex copying, i.e. forming images on both surfaces of a sheet. This invention is also applicable to an image forming apparatus which is capable of overlay copying, i.e. forming images plural times on the same surface of a sheet.

2. Description of the Prior Art

Recently image forming apparatus providing a variety of functions, for example, the functions capable of duplex copying and overlay copying have been proposed and come into commercial acceptance. In order to achieve duplex copying and/or overlay copying, the image forming apparatus comprises a receiving unit for receiving a sheet on which a first image is formed, and the sheet is re-fed out of the receiving unit to form a second image thereon.

In a conventional duplex and/or overlay image forming apparatus, the receiving unit comprises an inlet for receiving the sheet, a tray member for supporting the received sheet, an aligning device for aligning the sheet on the tray member, and an outlet through which the received sheet is re-fed. The aligning device comprises a pair of standing members which stand upright and extend to a level lower than the inlet. The standing members are positioned in spaced relationship with each other in a widthwise direction (in a direction perpendicular to a feed direction), and slidable toward each other by a driving means. Before the sheet is received in the tray member, the standing members are set at a first position where they are positioned in spaced relationship with each other a predetermined distance much wider than the width of the sheet so that the tray member can receive the sheet between the standing members certainly. Then the sheet is received in the tray, the standing members are slide by the driving means to a second position where they are in contact with the lateral sides of the sheet, and the sheet is aligned.

The conventional apparatus, however, has the following problems to be solved.

Firstly, mainly due to the lowness of the top of the standing members, the sheet turns aside during receiving in the tray member from the inlet. Therefore the standing members are positioned where they are spaced from each other a predetermined distance much wider than the width of the sheet so that the tray member can receive the sheet between the standing members certainly. When the tray member receives the sheet, the standing members slide to a second position where they are in contact with the sheet. Moreover, the standing members have to be slid to align the sheets every time each sheet is received. However, it takes much time to align the sheets so the image forming speed cannot be so fast.

Secondly, the image forming speed may be fast, when a motor having much torque is adopted for sliding the standing members fast. Alternatively, a particular structure may be adopted for the purpose. However, such motor or such a particular structure is large in size, relatively complex in structure, and the cost is relatively high.

SUMMARY OF THE INVENTION

It is an object of this invention to provide a novel and improved image forming apparatus which is capable of rapid dual or overlay image forming by adding a simple structure.

It is another object of this invention to provide a novel and improved image forming apparatus in which the tray member can receive the sheet between the pair of standing members certainly.

In order to attain the above objects, an image forming apparatus of the present invention comprises the standing members which extend upward to a level which is higher than the inlet, and at least one of the pair of standing members has a widened portion for guiding the sheet from the inlet.

The sheet proceeding from the inlet into the tray member is guided by the widened portion and received between the standing members certainly. Therefore the sheet is regulated substantially accurately even though the space between the standing members is a little wider than the width of the sheet and nearly substantially the width of the sheet, and it is enable to save the aligning time more than before.

Further objects of this invention along with its advantages will become apparent from the following detailed description taken in conjunction with the accompanying drawings

DETAILED DESCRIPTION OF PREFERRED EMBODIMENTS

With reference to the accompanying drawings, specific embodiments of the image forming apparatus constructed in accordance with this invention will be described in detail.

Figure 1:
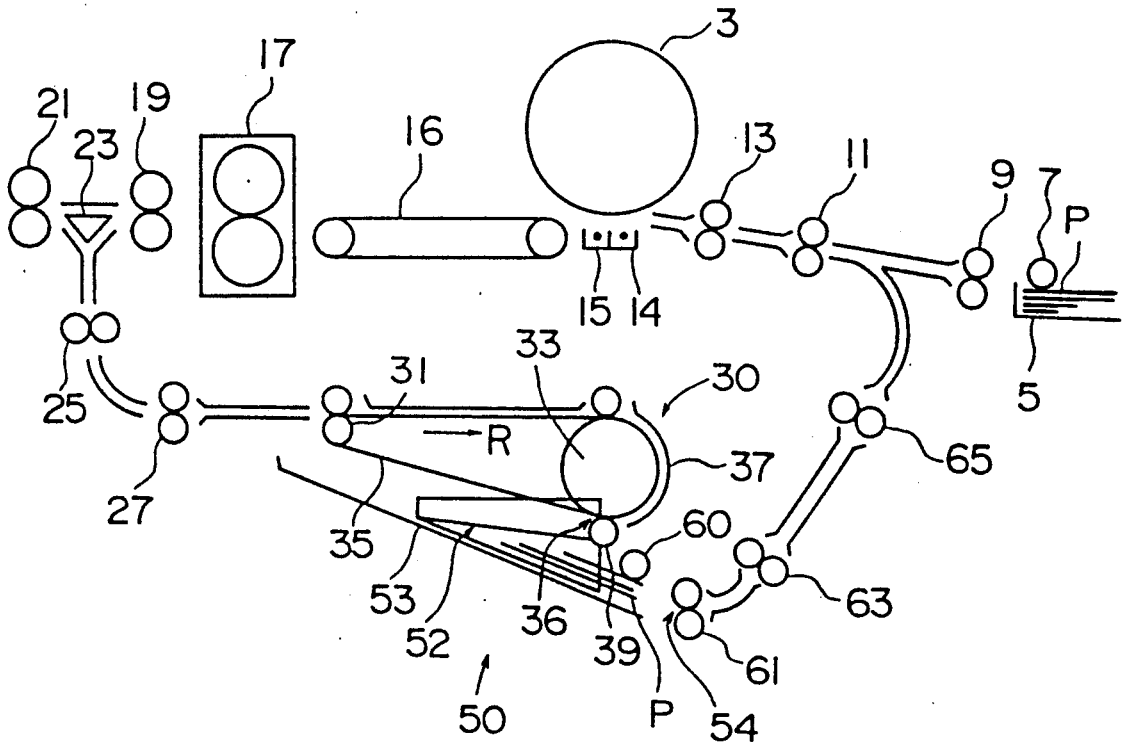
FIG. 1 is a schematic view showing a first embodiment of a dual image forming apparatus having a receiving unit constructed in accordance with this invention.

FIG. 1 illustrates in a simplified form one specific embodiment of the image forming apparatus having a receiving unit constructed in accordance with this invention. In the upper and nearly central portion in FIG. 1 is disposed a photo-sensitive drum 3 on the surface of which a toner image is formed by a well-known image processing unit (not shown). In the right end portion in FIG. 1 is disposed a cassette 5 in which sheets P are stacked, and the sheets P are fed from the cassette 5 one by one by a feed roller 7. Between the cassette 5 and the photo-sensitive drum 3 are disposed a conveying roller pair 9, 11, and a registration roller pair 13 in this order in the sheet feed direction. The sheet P fed from the cassette 5 is conveyed by the conveying roller pair 9, 11 to the registration roller pair 13. Then the leading edge of the sheet P is registrated by the registration roller pair 13 and the sheet P is conveyed by the roller pair 13 synchronizing with the movement of the toner image on the surface of the photosensitive drum 3, so that the toner image is accepted on a predetermined portion of the sheet P. On the downstream side of the registration roller pair 13 and around the photo-sensitive drum 3 are disposed a transfer corona discharge device 14 and a peeling corona discharge device 15. The toner image on the photo-sensitive drum 3 is transferred to the sheet P by the transfer corona discharge device 14 and the sheet P is peeled from the drum 3 by the peeling corona discharge device 15. On the downstream side of the peeling corona discharge device 15 are disposed a conveying belt 16, a fixing device 17, a conveying roller pair 19, a changeover guiding plate 23 and a discharge roller pair 21 in this order in the sheet feed direction. The sheet P peeled from the drum 3 is conveyed by the conveying belt 16 to the fixing device 17, and the toner image is fixed on the sheet P as a permanent image by the fixing device 17. After fixing, the sheet P is conveyed by the conveying roller pair 19. The sheet P conveyed by the roller pair 19 is discharged outside of the machine through the changeover guiding plate 23 and the discharge roller pair 21, or guided downward by the changeover guiding plate 23. In other words, the changeover guiding plate 23 is rotated between a first position where the sheet P is guided to the discharge roller pair 21 and a second position where the sheet P is guided downward to a reversing device 30 which is described hereinbelow. Reference numbers 25 and 27 are conveying roller pairs and they convey the sheet P to the reversing device 30 which turns the sheet P upside down.

The reversing device 30 mainly comprises a small diameter roller 31, a large diameter roller 33, a belt 35 stretched around the small diameter roller 31 and the large diameter roller 33 and rotatable in the direction of an arrow R, a curved guide plate 37 which defines a reversing portion with the large diameter roller 33, and a roller 39 which is provided at the bottom of the guide plate 37 and driven by the belt 35.

The large diameter roller 33 and the roller 39 which is in contact with the roller 33 through the belt 35 define an inlet 36 of a receiving unit 50. The receiving unit 50 comprises said inlet 36 for receiving the sheet P, a tray member 53 supporting the received sheet P, an aligning device 52 which is described in detail hereinafter, and an outlet 54 through which the received sheet P is re-fed. The sheets P are fed succesively through the inlet 36 and stacked on the tray member 53.

The received sheets P on the tray member 53 are re-fed by a re-feeding roller 60 through the outlet 54. The outlet 54 is defined by a roller pair 61. The roller pair 61 re-feed the sheets P one by one to said registration roller pair 13 through a roller pair 63, 65, and the conveying roller pair 11 to form a second image thereon.

Figure 2:
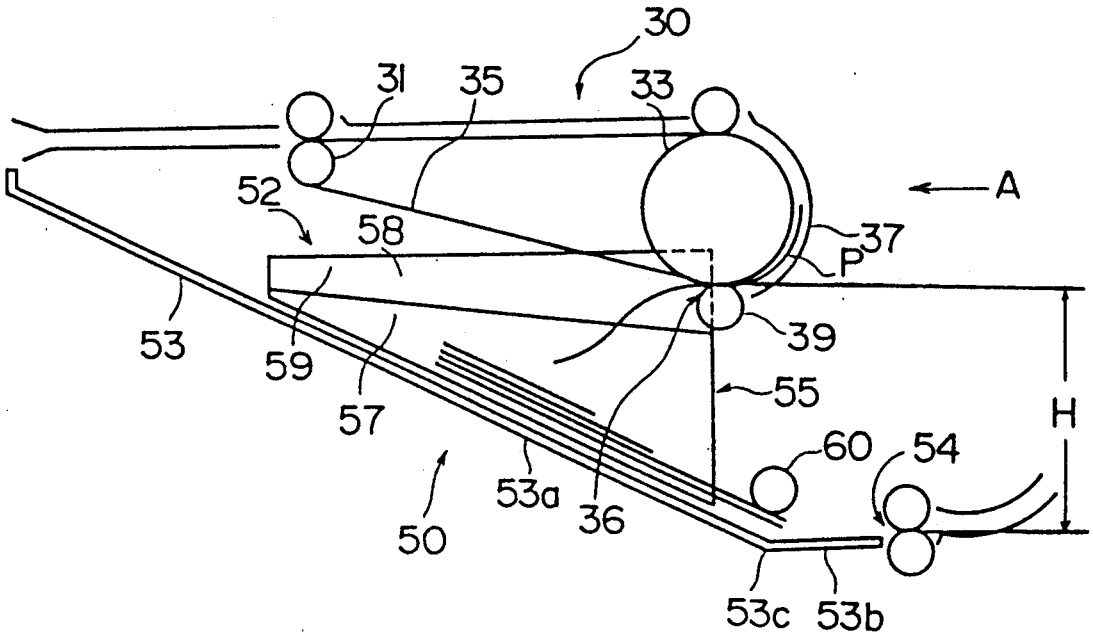
FIG. 2 is a partial schematic view showing the receiving unit in the image forming apparatus of FIG. 1.
Figure 3:
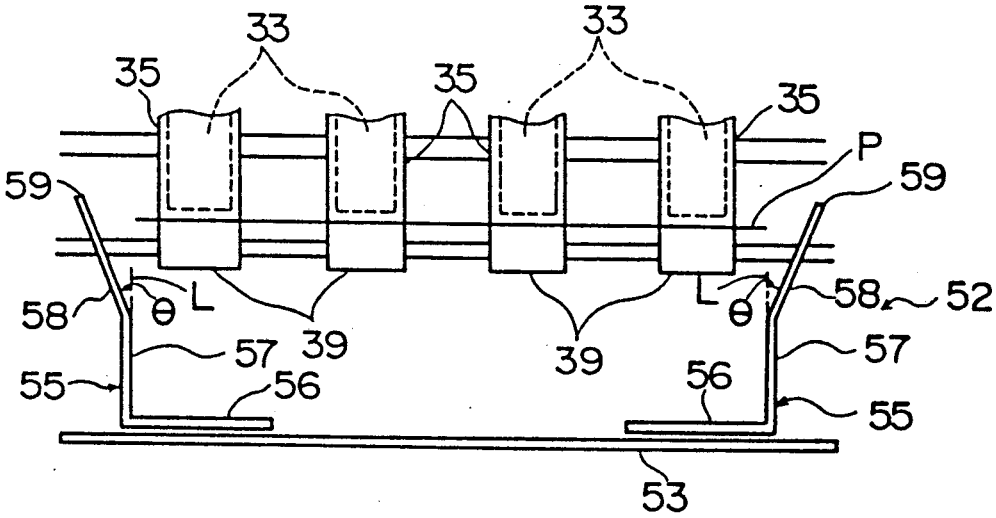
FIG. 3 is a side elevational view of the receiving unit as viewed in the direction of an arrow A in FIG. 2.

FIG. 2 is a partial schematic view showing the receiving unit 50 and FIG. 3 is a side elevational view of the receiving unit 50 as viewed in the direction of an arrow A in FIG. 2.

With reference to FIG. 2, the tray member 53 is almost inclined with the outlet side portion (the right side portion in FIG. 2) thereof lower than the remainder. More exactly, the tray member 53 is composed of a main inclined portion 53*a* and an almost horizontal portion 53*b*, and an outlet side point 53*c* of the main inclined portion 53*a* is lower than the remainder of the main inclined portion 53*a*. Therefore the received sheets P are slipped down by their own weights on the main inclined portion 53*a* of the tray member 53 and the longitudinal edges are aligned.

With reference to FIGS. 2 and 3, said aligning device 52 comprises a pair of standing members 55, 55 positioned on the tray member 53. The standing members 55, 55 are positioned in spaced relationship with each other in a widthwise direction (in a direction perpendicular to the feed direction), and slidable toward each other by a well-known driving means (not shown). The standing members 55, 55 are formed as follows. The standing members 55, 55 are composed of bottom portions 56, 56 which are parallel to the tray member 53, upright portions 57, 57 which are integral with the bottom portions 56, 56 and extend upright, and inclined portions 58, 58 which are integral with the upright portions 57, 57 and inclined outwardly. The tips 59, 59 of the standing members 55, 55 are higher than said inlet 36 [the nip portion of the roller 39 and the large diameter roller 33 (or the belt 35)]. In FIG. 3, it is noted that the level where the sheet P is positioned is coincident with the level of the inlet 36. Moreover, the inclined portions 58, 58 extend, beginning with a level lower than the inlet 36 and terminating in a level higher than the inlet 36. In the embodiment of FIG. 3, the upmost points of the inclined portions 58, 58 are coincident with the tips 59, 59, and in this case the inclined portions 58, 58 are equivalent to widened portions for guiding the sheet P from the inlet 36.

Figure 4:
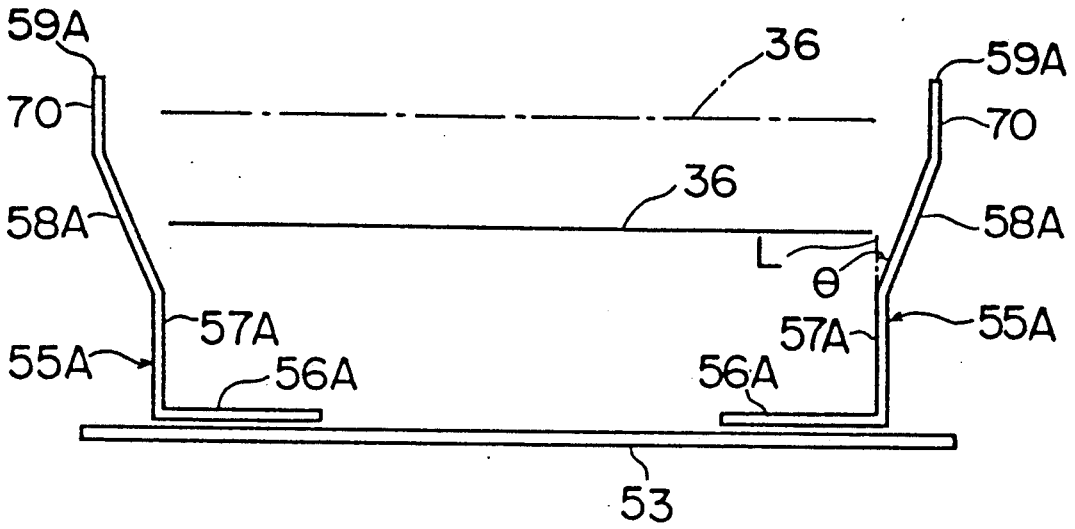
FIG. 4 is a side elevational view of an aligning device according to another embodiment of the present invention.

Alternatively, the upmost points of the inclined portions 58, 58 may not be coincident with the tips 59, 59. FIG. 4 illustrates such an embodiment. In FIG. 4, a pair of standing members 55A, 55A are composed of bottom portions 56A, 56A, upright portions 57A, 57A, inclined portions 58A, 58A, which are corresponding to the portions 56, 56; 57, 57; 58, 58 in FIG. 3 respectively, and other upright portions 70, 70 which are integral with the inclined portions 58A, 58A and extend upright. In this embodiment, the upmost points of the inclined portions 58A, 58A are not coincident with the tips 59A, 59A of the standing members 55A, 55A, but if the space between the standing members 55A, 55A widens at the portion corresponding to the level of the inlet 36 and the standing members 55A, 55A have guiding portions which guide the sheet P from the inlet 36 to the space between the upright portions 57A, 57A, it is achieved the objects of this invention. In FIG. 4, in the case that the inlet 36 is positioned at the level shown by the solid line, the portion corresponding to the level is the inclined portions 58A, 58A, and in the case that the inlet 36 is positioned at the level shown by the one-dot chain line, the portion corresponding to the level is the other upright portions 70, 70. In the former case, the space between the inclined portions 58A, 58A is wider than the space between the upright portions 57A, 57A. And in the latter case, the space between the other upright portions 70, 70 is wider than the space between the upright portions 57A, 57A, thus the standing members 55, 55; 55A, 55A receive the sheet P therebetween confirmly. Moreover, the sheet P is guided by the inclined portion 58A, 58A to the space between the upright portions 57A, 57A. Accordingly, the inclined portions 58A, 58A and the other upright portions 70, 70 are equivalent to the widened portions for guiding the sheet P from the inlet 36.

In reference to the FIGS. 3 and 4, the inclined portion 58, 58; 58A, 58A are inclined outside, and an angle $\theta$ of the inclined portions 58, 58; 58A, 58A formed with the perpendicular line L is preferably within about 15 to 30 degrees. By providing the inclined portions 58, 58; 58A, 58A, the sheet P smoothly slips down by its own weight and is guided toward the space between the upright portions 57, 57; 57A, 57A.

Now, with reference to FIGS. 2 and 3, an operation of the receiving unit 50 will be described. The sheet P which the first image formed thereon and turned over by the reversing device 30 is fed onto the tray member 53 by the belt 35 and the roller 39, the nip portion of which defines the inlet 36. The standing members 55, 55 are positioned at intervals for receiving the sheet therebetween. More precisely, the space between the upright portions 57, 57 of the standing members 55, 55 is a little wider than the width of the sheet P and nearly substantially the width of the sheet P. But the standing members 55, 55 have the inclined portions 58, 58 which are inclined outside, so that the sheet P can be easily accommodated between the standing members 55, 55, and guided toward the space between the upright portions 57, 57. In other words, the tips 59, 59 of the standing members 55, 55 are higher than the level of the inlet 36, and the space between the portions corresponding to the level of the inlet 36 is wider than the space between the upright portions 57, 57, and therefore the sheet P is received between the standing members 55, 55 confirmly. Moreover, the inclined portions 58, 58 are inclined, so that the sheet P can be smoothly slipped down by its own weight and guided toward the space between the upright portions 57, 57. Thus if the sheet P may turn aside when it is fed from the inlet 36, the lateral sides of the sheet P are regulated by the standing members 55, 55. And the space between the upright portions 57, 57 is nearly substantially the width of the sheet P, the sheet P is received at a predetermined position on the tray member 53. The sheets P formed the first images thereon are succesively stacked one by one on the tray member 53. However, all of them are regulated in the same manner, and thus the sheets P are almost aligned and are not so scattered. Accordingly, the standing members 55, 55 do not need to be adjusted to align the sheets every time each sheet is received. And, when a plural of sheets are stacked, the standing members 55, 55 are slid by the driving means. As the distance to be slid is much shorter and the aligning times are reduced, it is possible to save on the time for alignment much more than before, and it makes the image forming speed much faster.

It is noted that the longitudinal edges of the sheet P are aligned when the sheet P slips down by is own weight on the main inclined portion 53*a* of the tray member 53. And the stacked and aligned sheets P are re-fed one by one through the outlet 54 to form the second images.

Figure 5:
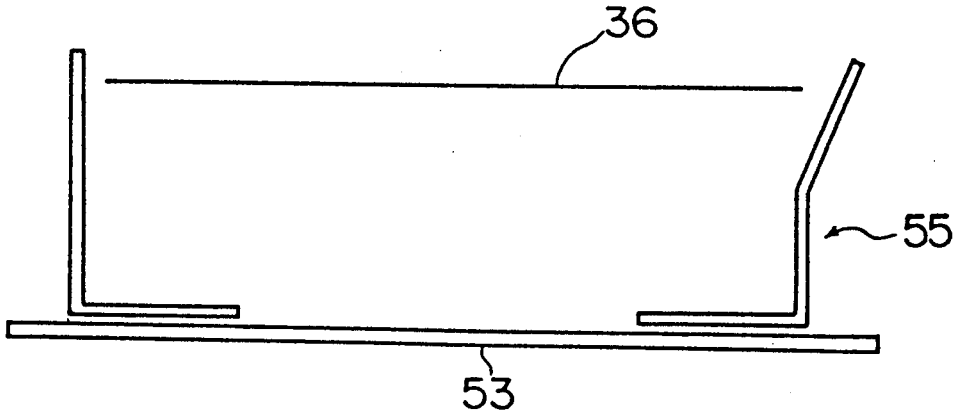
FIG. 5 is a side elevational view of an aligning device according to further embodiment of the present invention.

In the above embodiments, both of the standing members 55, 55; 55A, 55A are provided with the inclined portions 58, 58; 58A, 58A. But even if one of the standing members is provided with the inclined portion and the other of them has only the bottom portion and the upright portion, substantially the same result can be obtained. Especially, this embodiment (the embodiment that one of the standing members has a inclined portion) is preferrably applicable to the machine which adjusts the original to the sheet at one end. FIG. 5 shows the embodiment.

Further in the above embodiments, the inlet 36 is positioned nearly or substantially right over the outlet 54 and the tray member 53 is inclined with the outlet side portion thereof lower than the remainder. Accordingly, the height H (see FIG. 2) between the inlet 36 and the outlet 54 is considerable, and moreover the tend is remarkable when the machine is of high speed and a plenty of the sheets are processed at one time. In such a machine, the sheets P are apt to be scattered when they dropped down by their own weights, therefore this invention becomes more effective. However, this invention is also applicable to a machine that said inlet is not positioned nearly or substantially right over the outlet 54, but positioned rear (left hand side in FIG. 1) and upward of the side of the tray member 53. The example of such a machine is disclosed in U.S. Pat. No. 4,734,738.

More further, in the above embodiments, the image forming apparatus is capable of duplex copying, but not capable of overlay copying. Without the reversing device 30, the image forming apparatus is capable of overlay copying, but not duplex copying. And if there are provided with said reversing device 30 and a changeover lever which selectively guides the sheet P from the conveying roller pair 27 to the receiving device 50 directly or through the intermediate reversing device 30, the image forming apparatus is capable of duplex copying and overlay copying.

Although the present invention has been described by way of embodiments with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. An image forming apparatus, comprising:

means for forming an image on a sheet;

means for feeding the sheet on which a first image is formed by said image forming means;

a receiving means for receiving the sheet fed by said feeding means, said receiving means comprising an inlet for receiving the sheet, a tray member for supporting the received sheet, an outlet through which the received sheet is re-fed, and means for aligning the sheet, wherein said aligning means comprises a pair of standing members positioned on the tray member in spaced relationship with each other at a predetermined distance, said standing members extending out away from the inlet in a sheet discharging direction, said standing members extending upward to a level which is higher than said inlet, and each of said pair of standing members having a widened portion with a first and second end for guiding the sheet from the inlet, said first end being positioned closer to said inlet than said second end, and said inlet including a pair of rollers and said pair of rollers each extending between said widened portions and a portion of each one of said pair of rollers being positioned between said first and second ends of said standing members; and means for re-feeding the sheet out of said receiving means to form a second image thereon.

2. An image forming apparatus of claim 1, wherein said widened portion is inclined outwardly.

3. An image forming apparatus of claim 2, wherein said widened portion is inclined outwardly at 15 to 30 degrees to a perpendicular line.

4. An image forming apparatus of claim 1, wherein said tray member is inclined with an outlet side portion thereof lower than the remainder of said tray member.

5. An image forming apparatus of claim 4, wherein said inlet is positioned substantially right over said outlet.

6. An image forming apparatus of claim 5, wherein said inlet is defined by a pair of rollers for feeding the sheet to said tray member after the sheet is turned over.

7. An image forming apparatus of claim 6, wherein one of said pair of rollers serves as means for reversing the sheet.

8. An image forming apparatus of claim 1 wherein said widened portions extend over the entire length of the standing member in the sheet discharging direction.

9. An image forming apparatus, comprising:

means for forming an image on a sheet;

means for feeding the sheet on which a first image is formed by said image forming means;

a receiving means for receiving the sheet fed by said feeding means, said receiving means comprising an inlet for receiving the sheet, a tray member for supporting the received sheet, an outlet through which the received sheet is re-fed, and aligning means for aligning the sheet, wherein said aligning means comprises a pair of standing members positioned on the tray member in spaced relationship with each other at a predetermined distance, said standing members extending out away from the inlet in a sheet discharging direction and said standing members extending upward to an upper edge which is higher than said inlet and each of said standing members having an outwardly inclined widened-portion with each outwardly inclined widened portion defining an outwardly inclined planar surface having a lower folded edge below said inlet, and said planar surface being dimensioned and arranged such that a paper sheet discharged into said aligning means has, at the point of discharge, a forward end extending out in the discharge direction essentially parallel with the upper edge of said planar surfaces.

10. An image forming apparatus of claim 9 wherein said standing members include a first end and a second end with said first end positioned closer to said inlet than said second end and said inlet including a pair of rollers and said pair of rollers each extending between said inclined planar surfaces and a portion of each one of said pair of rollers being positioned between said first and second end of said standing member.

* * * * *